United States Patent [19]

Delesandri

[11] Patent Number: 4,846,271

[45] Date of Patent: Jul. 11, 1989

[54] ADJUSTABLE MECHANISM FOR STABBING AND THREADING A DRILL PIPE SAFETY VALVE

[76] Inventor: Domenico Delesandri, P.O. Box 428, League City, Tex. 77573

[21] Appl. No.: 162,050

[22] Filed: Feb. 29, 1988

Related U.S. Application Data

[63] Continuation of Ser. No. 877,751, Jun. 24, 1986, abandoned.

[51] Int. Cl.[4] ..... E21B 33/038

[52] U.S. Cl. ..... 166/78; 166/85; 166/95; 74/422; 29/237

[58] Field of Search ..... 173/163–165; 175/85; 74/422, 89–11, 400, 411, 842; 166/85, 78, 95, 97; 408/135; 285/912, 18; 29/237, 240

[56] References Cited

U.S. PATENT DOCUMENTS

| | | | |
|---|---|---|---|
| 1,831,878 | 11/1931 | Myracle | 166/85 |
| 1,896,236 | 2/1933 | Howard et al. | 137/111 |
| 2,010,992 | 8/1935 | Howard | 255/35 |
| 2,147,002 | 2/1939 | Volpin . | |
| 3,254,542 | 6/1966 | Donath | 408/135 |
| 3,505,913 | 4/1970 | Dickmann et al. | 81/57.35 |
| 3,545,313 | 12/1970 | Kelley | 81/57.34 |
| 3,625,282 | 12/1971 | Bridges | 166/92 |
| 3,877,529 | 4/1975 | Litchfield | 166/77.5 |
| 4,026,354 | 5/1977 | Burrow | 166/95 |
| 4,291,762 | 9/1981 | Gudgel | 166/85 |
| 4,423,774 | 1/1984 | Mefford | 166/77.5 |
| 4,442,892 | 4/1984 | Delesandri | 166/85 |
| 4,494,425 | 1/1985 | Shewmake, Sr. | 81/57.34 |

*Primary Examiner*—Donald R. Schran
*Assistant Examiner*—James L. Wolfe
*Attorney, Agent, or Firm*—Arnold, White & Durkee

[57] ABSTRACT

An apparatus for stabbing and threading a safety valve into a well pipe to prevent upward flow comprises a tubular canister rotatably mounted on a carriage assembly that is slidably mounted on an upstanding frame. The lower end of the frame has a swivel mounting to a bracket that is attached to the side of an elevator-type clamp by which the apparatus is clamped onto the upper end portion of the pipe. An alignment mechanism moves the frame from a first position wherein the canister is not aligned with the pipe to a second position wherein the canister and pipe are aligned and the safety valve can be stabbed and threaded into the pipe. A variable drive mechanism is operated to cause the canister, and the valve located therein, to be rotated and simultaneously lowered toward the pipe. The drive mechanism may be adjusted to facilitate threading of the valve into a variety of drill pipe thread designs. An improved clamp assembly allows adjustment in its size so as to accommodate drill pipe of various diameters.

4 Claims, 6 Drawing Sheets

ADJUSTABLE MECHANISM FOR STABBING AND THREADING A DRILL PIPE SAFETY VALVE

This is a continuation of co-pending application Ser. No. 877,751 filed on June 24, 1986 now abandoned.

BACKGROUND OF THE INVENTION

1. Field of the Invention

The present invention pertains to drill pipe safety valves used for capping oil field drill pipe when a blowout occurs through the pipe. More particularly, the present invention provides a mechanism for positioning the safety valve over the drill pipe and for altering the device for use on various drill pipe and thread patterns.

2. Related Art

When during the drilling of an oil well the bit penetrates an earth formation having an unexpectedly high pressure, the hydrostatic head of the drill mud standing in the well may not be sufficient to prevent formation fluids from entering the bore hole and traveling upward toward the surface. If such flow is not controlled quickly, a "blowout" of the well can occur and create very serious safety hazards of personnel working on and around the drilling rig. Of course a resulting fire can cause tremendous damage to the drilling equipment. At first indication of possible blowout conditions, the blowout preventers can be closed a round the drill pipe to seal off the annulus. If the kelly by which the drill pipe is driven happens to be attached to the upper end of the string of drill pipe, a valve may be present in the system which can be closed to shut off upward flow through the drill pipe itself. However, should upward flow begin while the kelly is not connected to the drill pipe, for example while a threaded connection between pipe sections is being made, a very hazardous situation is presented.

U.S. Pat. No. 4,026,354, issued May 31, 1977, shows a somewhat massive device that is lowered over the open end of the pipe by a crane or a boom and operated by a long drive shaft that extends through a kill line in order to make a connection with the pipe and enable a shut-off valve to be closed. Due to its massive nature, this device could not be positioned and put into operation as quickly as would obviously be desirable under the circumstances. U.S. Pat. No. 3,625,282, issued Dec. 7, 1971, shows a device having a clamp that mates only with a special type of groove arrangement on the upper end of the casing, the clamp having bolt holes that can be aligned with matching holes on the lower flange of a spool which mounts a master valve. The clamp and spool have an offset hinge bolt to enable the spool to be pivoted into position. However this apparatus requires the makeup of numerous bolts before complete attachment can be accomplished, which is time-consuming and thus potentially dangerous, and the clamp assembly is designed for attachment only to a specific type of machined end fitting.

Applicant is the inventor of the invention claimed in U.S. Pat. No. 4,442,892, issued Apr. 17, 1984, which patent is expressly incorporated herein by reference for all purposes, and which shows an apparatus for stabbing and threading a safety valve into a well pipe. The apparatus comprises a tubular canister rotatably mounted on a carriage assembly that is slidably mounted on an upstanding frame. The lower end of the frame has a swivel mounting to a bracket that is attached to the side of an elevator-type clamp means by which the apparatus is clamped onto the upper end portion of the pipe. With the canister pivoted into position over the pipe, a gear drive is operated by a hand wheel to cause the canister to be rotated and simultaneously lowered toward the pipe whereby a safety valve mounted inside the canister is automatically threaded ino the upper end of the pipe and can be closed to shut off upward flow.

It is a general object of the present invention to provide a mechanism to facilitate operation of an apparatus such as that described in U.S. Pat. No. 4,442,892 by providing a means for controllably positioning the safety valve over a drill pipe of variable diameter and providing an adjustment in the rotation and lowering of the safety valve dependent upon the type of drilling equipment involved.

SUMMARY OF THE INVENTION

The mechanism of the present invention provides mechanized control of alignment between a safety valve and a drill pipe string into which the valve is to be threaded. Further, the present invention provides adjustability in the drive mechanism of a safety valve stabbing device so that the device can be quickly and easily adjusted for use with a variety of drill pipe thread designs. An improved clamp assembly allows the use of the mechanism on drill pipe joints of varying diameters.

Alignment control may be achieved through the use of an alignment screw which is threaded through a pivoting alignment nut on a lower pivot baseplate, one end of the alignment screw being captured by an alignment stop on an upper pivot baseplate. When the alignment screw is turned, the rotational angle between the lower and upper baseplates is adjusted. The alignment screw may be appropriately driven by hand wheel or by electric, hydraulic, pneumatic, or other means.

The safety valve stabbing device may be adjusted so as to be compatible with a plurality of drill pipe thread designs. Drive gears are aligned so as to provide alternate engagement wih a rack member. A control lever and yoke assembly engages the drive gears and selects which of the gears will engage the rack member. An adjustment in the rack member is also made to facilitate engagement of the member with a selected drive gear. By selecting an appropriate drive gear and rack member position, the rate of rotation of the safety valve to be threaded into the drill pipe and its vertical movement as it is threaded into that pipe, can be coordinated so as to be compatible with a variety of drill pipe thread designs.

A clamp assembly is provided with removeable grips which can be readily changed to adjust to the diameter of the drill pipe being used. Adjustability of the clamp assembly enhances the versatility of the mechanism, making it useable on a variety of drill pipe diameters without the necessity of changing the clamp assembly as a whole.

DETAILED DESCRIPTION OF A PREFERRED EMBODIMENT

Figure 1:
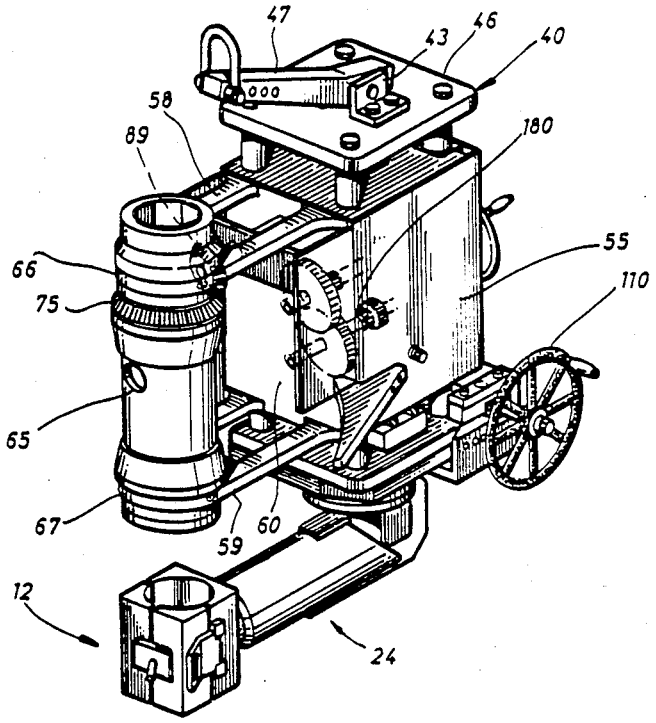
FIG. 1 is a perspective view of a safety valve stabbing apparatus utilizing the improved clamp assembly, adjustable drive assembly and alignment assembly of the present invention.

Referring to FIG. 1, an apparatus constructed in accordance with the principles of the present invention is shown as including a clamp assembly indicated generally at 12 that is arranged to be positioned around the upper end portion of a joint of drill pipe below the internally threaded box end thereof. The drill pipe joint is suspended by slips in the rotary table on the floor of the derrick. The positioning of the apparatus with respect to a joint of drill pipe is generally the same as that described in U.S. Pat. No. 4,442,892. Clamp assembly 12 supports a frame assembly 40 which is rotatable about a vertical axis. A carriage 55 is arranged to move vertically relative to the frame 40 and supports a canister 65 which rotates relative to the carriage 55. An alignment mechanism 110 controls vertical alignment between clamp assembly 12 and canister 65 by causing a rotation of frame assembly 40 with respect to clamp assembly 12. A variable drive mechanism 180 coordinates rotation of canister 65 with vertical movement of carriage 55 and is adjustable to provide for various combinations of rotation and vertical movement.

Figure 2:
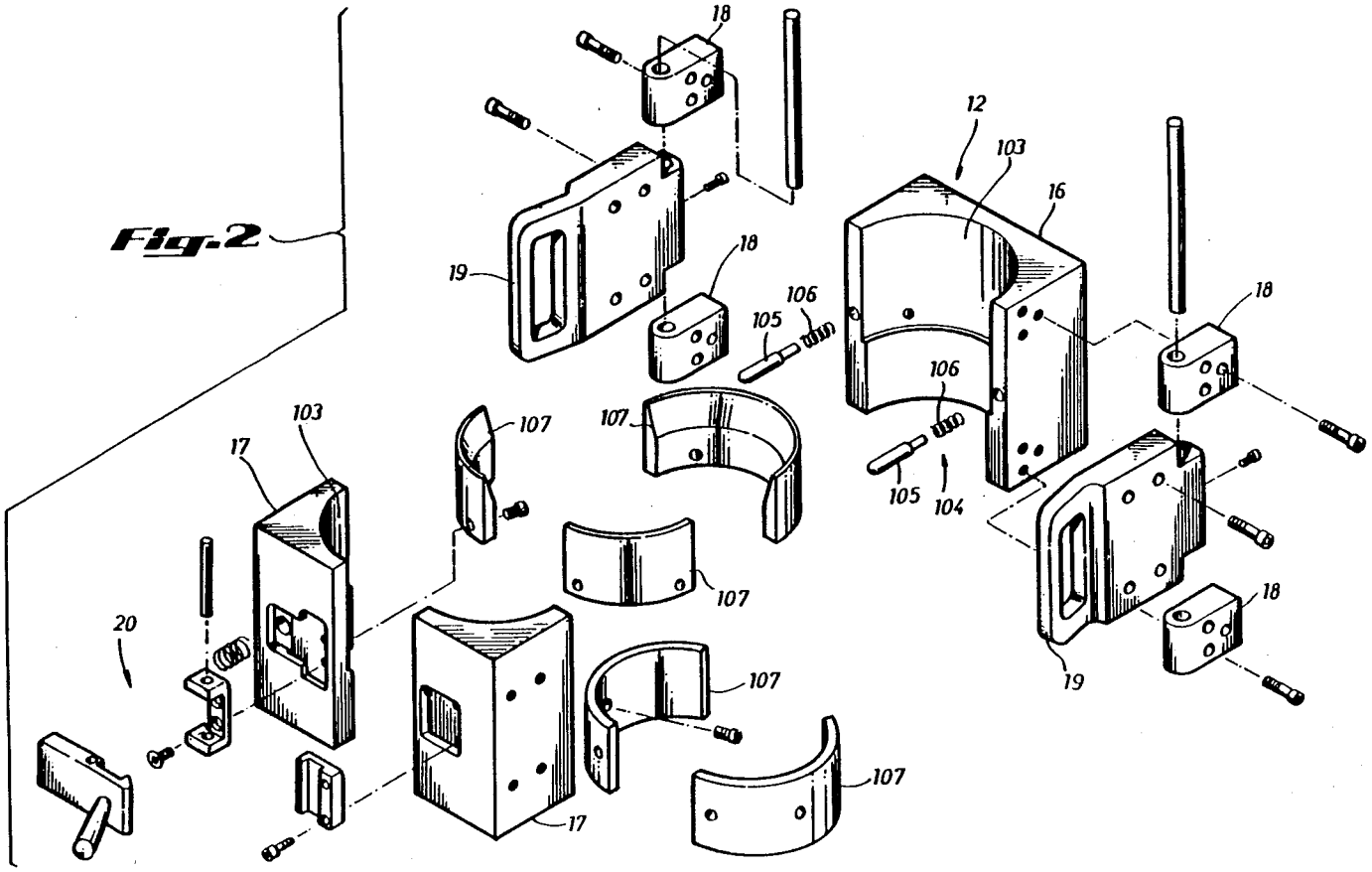
FIG. 2 is an exploded perspective view of a clamp assembly according to the present invention.

A preferred embodiment of clamp assembly, or elevator, 12 is illustrated in FIG. 2 and comprises generally four major components. Rear section 16 defines a semicylindrical portion of a bore 103. Front sections 17 each define a quarter cylindrical portion of bore 103. When rear section 16 and front sections 17 are joined, cylindrical bore 103 is completely defined. The diameter of bore 103 is generally greater than the expected outside diameter of a drill pipe joint on which the elevator will be utilized.

Attached to an external face of each front section 17 is a handle 19. Front section 17 is connected to rear section 16 by means of hinges 18. Hinges 18 provide vertical axes of rotation about which handles 19 and front sections 17 can rotate. Each front section 17 is connected to rear section 16 in a like manner. When thus hingeably connected, front sections 17 may be rotated outwardly with respect to one another and with respect to rear section 16 using handles 19 to open bore 103 so that the elevator device may be drawn around and clamped to a drill pipe joint 13.

Releasable latch device 20 is provided so that when front sections 17 are drawn toward each other to join, latch device 20 automatically engages to releasably attach front sections 17 and maintain a closed bore 103. Openers 104 each comprise a rod 105 and spring 106 which coact to bias front sections 17 in an open position. When latch 20 is opened, disconnecting front sections 17, openers 104 cause front sections 17 to swing outwardly, releasing the elevator 12 from the drill pipe joint.

Tubing grip sections 107 are positioned within bore 103 and removably attached to the inner walls of rear section 16 and front sections 17. Grip sections 107 are utilized to reduce the diameter of bore 103 to properly fit the diameter of the drill pipe joint on which the elevator will be attached. Because of the removability of grip sections 107, various sizes of grips may be utilized to provide flexibility and use of the elevator. That is, it can be used on drill pipe joints of various diameters without a change-out of the entire elevator.

Figure 3:
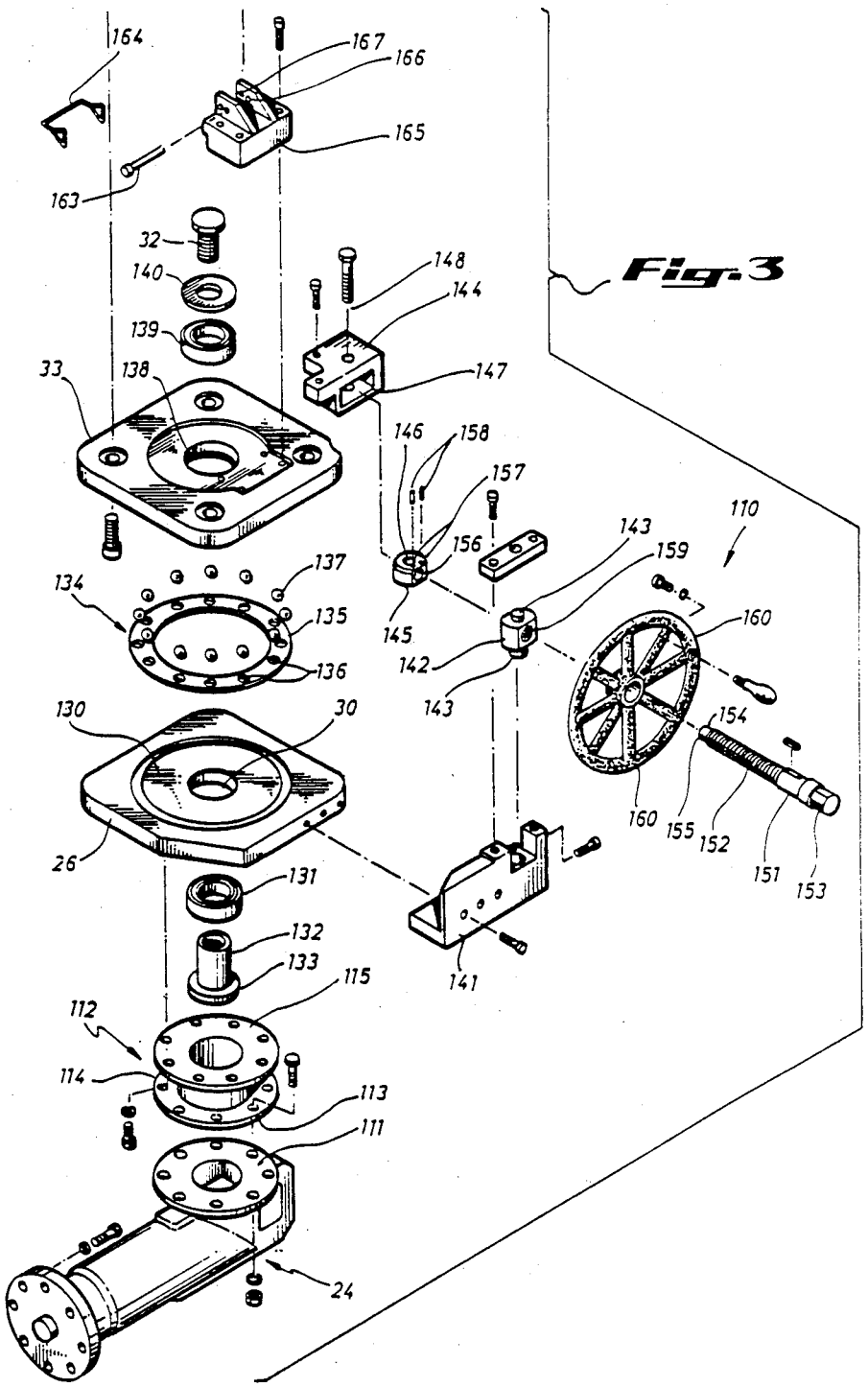
FIG. 3 is an exploded perspective showing an alignment mechanism according to the present invention.

A bracket 24 is connected to clamp assembly 12 and is of a type described in U.S. Pat. No. 4,442,892, which patent has been expressly incorporated herein by reference. Referring now to FIG. 3, attached to the vertical portion of bracket 24 is flange 111, with the face of flange 111 in a horizontal upward-facing orientation. Spacer assembly 112, generally comprising flange 113, pipe 114, and flange 115, provides a means for vertically spacing the frame assembly 40 from bracket 24. Although such vertical spacing will not always be required, it may be desirable in many circumstances.

An alignment mechanism 110 is shown in FIG. 3. Bolted or otherwise affixed to flange 115 (or alternatively to flange 111) is lower pivot baseplate 26. In the upper face of baseplate 26 is recess 130 which is circular in shape. Centered in baseplate 26 and recess 130 is a bore 30 which serves as a bearing race for lower pivot bearing 131. Bore 30 and recess 130 are concentric about one another and are centered on baseplate 26. Lower pivot bearing 131 is of a conventional cylindrical design having an inner and outer diameter. A Timken bearing, Part No. LM104900, has been utilized with success; however, other bearing designs may be used. Bearing 131 has an outer diameter which is approximately equal to the diameter of bore 30 and fits within bore 30. Pivot bearing hub 132 extends through pivot bearing 131 and seats against the lower face of baseplate 26 by means of a collar 133. Hub 132 is cylindrical in shape and has a circular bore along its longitudinal axis which is threaded for receiving a bolt, as will be more completely described below.

A bearing, generally designated at 134, comprises a Teflon column bearing retainer 135 which is a generally flat ring about which sockets 136 are spaced. Ball bearings 137 are positioned within sockets 136 and bearing 134 is positioned in recess 130 of baseplate 26. Ball bearings 137 have a diameter sufficiently large to protrude above the upper face of baseplate 26 when bearing 134 is positioned within recess 130.

Upper pivot baseplate 33 is substantially similar to lower baseplate 26 and has a bore 138 located at its center. The diameter of bore 138 is approximately equivalent to the diameter of bore 30 so as to receive upper pivot bearing 139 which is similar to lower pivot bearing 131. Base plate 33 is positioned atop bearing 134 such that pivot bearing hub 132 extnds through upper pivot bearing 139. Bearing hub 132 then provides an axis about which baseplate 33 can rotate with respect to baseplate 26. Bearing 134 facilitates that rotation and ball bearings 137 are of such diameter as to ensure sufficient separation between baseplate 33 and baseplate 26. Pivot bearing washer 140 is aligned with pivot bearing 139 and pivot bearing bolt 32 is threaded into the threaded internal bore of bearing hub 132. Base plate 33 and baseplate 26 are thus maintained in close proximity and parallel to one another and rotation of baseplate 33 with respect to baseplate 26 is provided.

Connected to baseplate 26 is lower bracket 141 for mounting alignment screw nut 142. Nut 142 has a threaded internal bore and has nipples 143 formed on opposing edges. Nipples 143 engage bracket 141 and define a vertical axis about which nut 142 may rotate. Screw nut 142 is thus captured by bracket 141 although it may be rotated in place about its generally vertical axis.

Attached to baseplate 33 is upper bracket 144 for housing screw stop 145. Stop 145 is generally cylindrical in shape having a bore 146 along its longitudinal axis and is adapted to fit within a slot 147 in bracket 144. Bore 146 aligns with holes located in bracket 144 and a bolt or pin 148 extends through the holes and through bore 146. Screw stop 145 is thus captured by upper bracket 144 and is allowed to rotate about a generally vertical axis defined by bolt or pin 148.

Alignment screw 151 generally comprises a threaded middle portion 152, a squared or hex head 153 and a neck 154. Alignment screw 151 is threaded through screw nut 142 and neck 154 is captured and held by screw stop 145. Neck 154 may be held by screw stop 145 using pins, snap rings, or other means which allow rotation of screw 151.

One way in which that may be accomplished is shown in detail in FIG. 3. Collar 155 and neck 154 may protrude into bore 156 of stop 145. Bores 157 in stop 145 are positioned astraddle bore 156 and extend parallel to bore 146 in screw stop 145. The horizontal distance between bores 157 is greater than the diameter of neck 154 but less than the diameter of collar 155. As neck 154 is positioned within bore 156, pins 158 are placed in bores 157 so as to capture collar 155 within screw stop 145. As alignment screw 151 is threaded into and out of threaded bore 159 of screw nut 142, collar 155 and neck 154 rotate within bore 156 and are prevented from escaping therefrom.

The distance between screw nut 142 and screw stop 145 may be varied by rotation of alignment screw 151. Because screw nut 142 and screw stop 145 are connected to baseplate 26 and baseplate 33 respectively, the rotational relationship between baseplate 33 and baseplate 26 may be varied by rotating alignment screw 151. As will be seen more clearly below, the rotation of baseplate 33 with respect to baseplate 26 allows alignment of canister 65 with clamp assembly 12.

Alignment wheel 160 is keyed to alignment screw 151 and facilitates its rotation. Alternatively, hydraulic, electrical, or pneumatic means may be employed to rotate alignment screw 151 to either align or misalign baseplates 33 and 26. Stops may be placed either on alignment screw 151 or baseplates 33 and 26 which limit rotation of screw 151 when the baseplates 33 and 26 are brought from misalignment to alignment position. Also, screw nut 142 and screw stop 145 may be positioned so that when they come into contact as a result of extreme rotation of alignment screw 151, baseplates 33 and 26 are in an aligned position.

Although a handwheel is shown as the means for rotating alignment screw 151 and varying the rotational relationship between baseplate 33 and baseplate 26, other devices such as electric motors or hydraulic or pneumatic drive units may be utilized and, in certain circumstances, may be desirable to increase operator safety. Indeed, alignment screw 151 may be replaced with a hydraulic piston or similar device which, by extension and retraction, varies the orientation of baseplate 33 with respect to baseplate 26.

Figure 4:
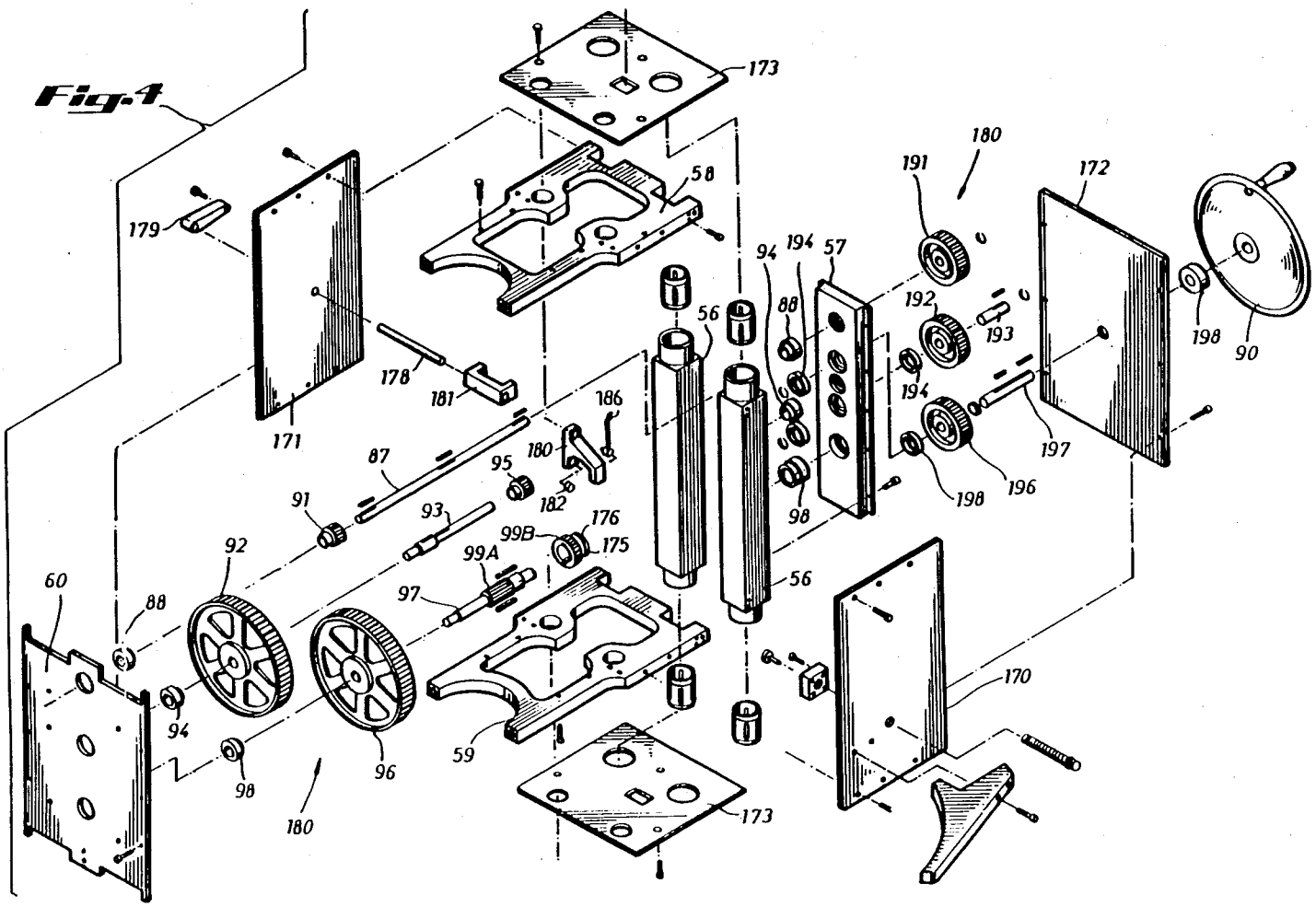
FIGS. 4 and 5 are exploded views showing a frame and carriage assembly and a drive mechanism utilizing the present invention.
Figure 5:
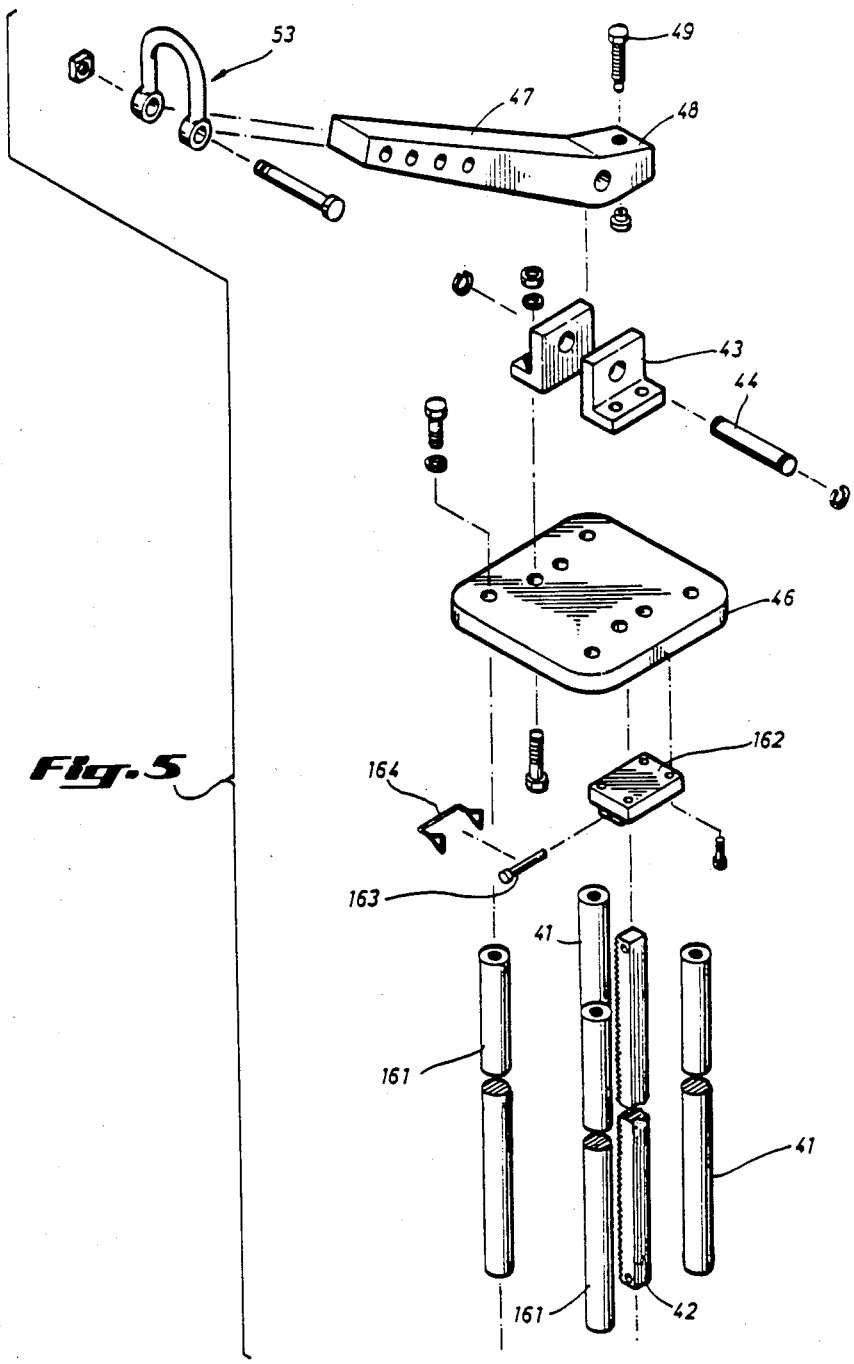

Referring now to FIGS. 3, 4, and 5, a frame assembly 40 similar to that described in U.S. Pat. No. 4,442,892 is secured to baseplate 33 and includes a pair of laterally spaced, vertically extending guide rods 41 and a pair of laterally spaced, vertically extending support rods 161. As seen in FIG. 3, rods 41 and 161 are secured to baseplate 33 by means of bolts or welding and are spaced about bore 138. Rods 41 and 161 generally extend vertically parallel to one another. As shown in FIG. 5, the upper ends of rods 41 and 161 are secured to top plate 46 by means of bolts, welding, or other adequate means. Base plate 33, top plate 46, and rods 41 and 161 provide a rectangular box structure whose longitudinal axis generally coincides with that of bearing hub 132. The structure is thus rotatable about its longitudinal axis on baseplate 26.

An elongated toothed rack member 42 extends vertically between the top plate 46 and baseplate 33. At its upper end, rack member 42 is held in place by support 162, shown in FIG. 5, which is bolted or otherwise connected to top plate 46. Support 162 has holes therein which, when aligned with a hole in the upper end of rack member 42, receives keeper pin 163. Safety clip 164 maintains keeper pin 163 in engagement with support 162 and rack member 42.

The lower end of rack member 42 is held in place by bracket 165, shown in FIG. 3, which is bolted to or otherwise connected to baseplate 33. Bracket 165 resembles support 162 and has at least two pairs of aligned holes 166 and 167. A single bore through the lower end of rack member 42 is alternatively aligned with holes 166 or 167 and keeper pin 163 maintains that alignment. Safety clip 164 maintains keeper pin 163 in engagement with bracket 165. Keeper pin 163 thus maintains the lower end of rack member 42 in the selected position. Bracket 165 and support 162 may each have a plurality of hole pairs which may be used in conjunction with the bores at either end of rack member 42 to maintain member 42 in a variety of positions. As will be more fully discussed below, such a variety of positions enables engagement with a variety of drive gears to produce different rates of vertical movement of carriage assembly 55 along guide rods 41.

A carriage, indicated generally at 55 in FIG. 1, is arranged to move vertically relative to the frame assembly 40. Referring to FIG. 4, the carriage 55 includes two guide tubes 56 that are slidably mounted on the rods 41, and which have a vertical panel or plate 57 affixed therebetween. Panel 57 may be bolted or welded, or attached by similar means, to guide tubes 56. Side plates 170 and 171 are situated parallel to one another and perpendicular to plate 57. Spaced laterally from and parallel to panel 57 are rear cover plate 172 and front cover plate 60. Cover plates 172 and 60 are bolted to side plates 170 and 171 to form a rectangular box structure about guide tubes 56 and panel 57. Upper arm member 58 extends between side plate 170 and side plate 171 and is bolted thereto and, at its rearward edge, engages guide tubes 56. Lower arm member 59 likewise extends between side plates 170 and side plate 171 and engages guide tubes 56 at its rearward edge. Arm members 58 and 59 each have laterally spaced vertical bores through which support rods 161 slidably extend. Arm members 58 and 59 also each have a laterally extending slot through which rack member 42 will extend when located in various positions by support 162 and bracket 165.

Upper and lower arm members 58 and 59 each extend horizontally beyond front cover plate 60 for connection to a tubular canister 65 in a manner similar to that described in U.S. Pat. No. 4,442,892, and which will be more fully described below. Horizontal cover plates 173 are affixed to members 58 and 59 and have circular bores and a slot through which rods 41 and 161 and rack member 42 may extend.

Rear cover plate 172, panel 57, and front cover plate 60 each have aligned openings formed therein which receive the bearings of shafts included in a drive mechanism 180. The drive mechanism 180 shown in FIG. 4 is used to rotate the canister 65, and a flow control device housed therein, as well as to move the canister 65 and its associated carriage 55 vertically with respect to the frame assembly 40. The drive mechanism 180 includes a drive shaft 87 extending between and protruding through plate 60 and panel 57. Shaft 87 is mounted in bearings 88 in plate 60 and panel 57 and has a bevel gear 89 mounted on an outboard end that meshes with a bevel gear 75 on canister 65. Drive shaft 87 extends through bearing 88 in panel 57 and has drive gear 191 keyed on its inboard end opposite bevel gear 89. A snap ring or similar means retains gear 191 on drive shaft 87. Drive gear 191 is located between panel 57 and rear cover plate 172 while bevel gear 89 is located outboard of front cover plate 60.

Idler shaft 193 is mounted in bearings 194 in panel 57. Idler gear 192 is keyed to idler shaft 193 and is held thereon by snap ring or similar means. Idler gear 192 meshes with drive gear 191 on drive shaft 87. Crank shaft 197 extends from paneel 57 and protrudes through rear cover plate 172. At its first end, shaft 197 is mounted in bearing 198 in panel 57. Crank gear 196 is keyed to shaft 197 which then extends through bearing 198 located in rear cover plate 172. On its second end, shaft 197 engages hand wheel 90 which facilitates rotation of crank gear 196. Crank gear 196 meshes with idler gear 192 on idler shaft 193. Thus, rotation of hand wheel 90 causes rotation of idler gear 192 which in turn causes rotation of drive gear 191. Bevel gear 89, being mounted on drive shaft 87 with drive gear 191, is thus made to rotate.

If desired, a torque limiting device, as discussed in U.S. Pat. No. 4,442,892, can be included in the drive train to provide for slippage when a predetermined torque value is exceeded. The limiting device, while not shown in detail, can include arcuate brake shoes carried on an outer housing that are pressed by adjustable studs inwardly against a circular brake surface mounted on the shaft 197 or shaft 87, for example.

Drive pinion 91 is keyed to drive shaft 87 intermediate panel 57 and front cover plate 60. Pinion 91 engages idler ring gear 92 which is keyed to idler shaft 93. Shaft 93 is mounted in bearings 94 in front cover platee 60 and panel 57. Also keyed to idler shaft 93 is idler pinion 95 so that idler ring gear 92 and idler pinion 95 rotate together.

Idler pinion 95 engages rack ring gear 96 which is keyed to shaft 97. Shaft 93 is mounted in bearings 98 in front cover plate 60 and panel 57. Also keyed to shaft 97 are rack pinion 99A and rack pinion 99B. Rack ring gear 96 and pinions 99A and 99B accordingly rotate together. Rack pinion 99B is slidable along the longitudial axis of shaft 97 and rack pinion 99A. Pinion 99B is slidable from a first position which is concentric with pinion 99A to a second position wherein it is longitudinally displaced from pinion 99A.

Connected to and coaxial with pinion 99B is colar 175 having a circumferential groove 176 therein. Shaft 178 protrudes through side plate 171 to engage control lever 179 on an outboard face of side plate 171. On its opposite end, shaft 178 is keyed to yoke 180 which is laterally spaced from side plate 171 by means of spacer 181. Yoke 180 is a fork-shaped structure which receives pins 182 in its parallel and opposite tines. Pins 182 mutually oppose one another and engage groove 176 of collar 175. Thus, rotation of control lever 179 results in a rotation of yoke 180 and a corresponding sliding movement of pinion 99B from its first position to its second, as described above. Control lever 179 and yoke 180 essentially enable the drive mechanism to "change gears," alternatively engaging pinions 99A and 99B with rack member 42. Pinions 99A and 99B alternatively engage toothed rack 42 depending on both the position of rack 42 and the position of pinion 99B with respect to pinion 99A.

As drive shaft 87 rotates, driven by hand wheel 90 and driving bevel gear 89, pinion 91 engages and rotates idler ring gear 92. Idler pinion 95 in turn engages and rotates rack ring gear 96, causing a contemporaneous rotation of pinions 99A and 99B. The selection of pinion 99A or pinion 99B to engage rack member 42 will determine the rate of vertical displacement of the carriage assembly 55 with respect to the rate of rotation of canister 65. Accordingly, in the illustrated embodiment, two drill pipe thread designs may be accommodated by altering the ratio between the rate of rotation of canister 65 and the rate of vertical displacement of the carriage assembly 55. In general, numerous drill pipe thread designs may be accommodated by adding additional pinion gears on shaft 97 and providing for numerous positions of rack member 42.

Although hand crank means are shown as the actuator of the drive mechanism, other means such as hydraulic, electric or pneumatic devices may be utilized as the cranking force. Such devices provide even greater operator saety by allowing the operator to be physically removed from the immediate vicinity of the apparatus as the safety valve is lowered and threaded into position.

Referring to FIG. 5, mounted atop top plate 46 is balance bar bracket 43, having aligned holes for receiving pin 44. A balance bar 47 that functions as a bail by means of which the apparatus can be suspended in a derrick on a flexible line is coupled to the frame assembly 40 by the shaft 44. The lower end of the bar 47 has an angled portion 48 with a threaded vertical aperture which receives an adjusting stud 49 which, when threaded through the aperture, bears against the top surface of the plate 46. Through adjustment of the stud 49, the angle of the balance bar 47 with respect to the plane of the top plate 46 can be changed in order that the apparatus can be caused to hang in a substantially vertical position from a flexible line which is attached by suitable means 53 to an eye in the upper end of the balance bar 47.

Figure 6:
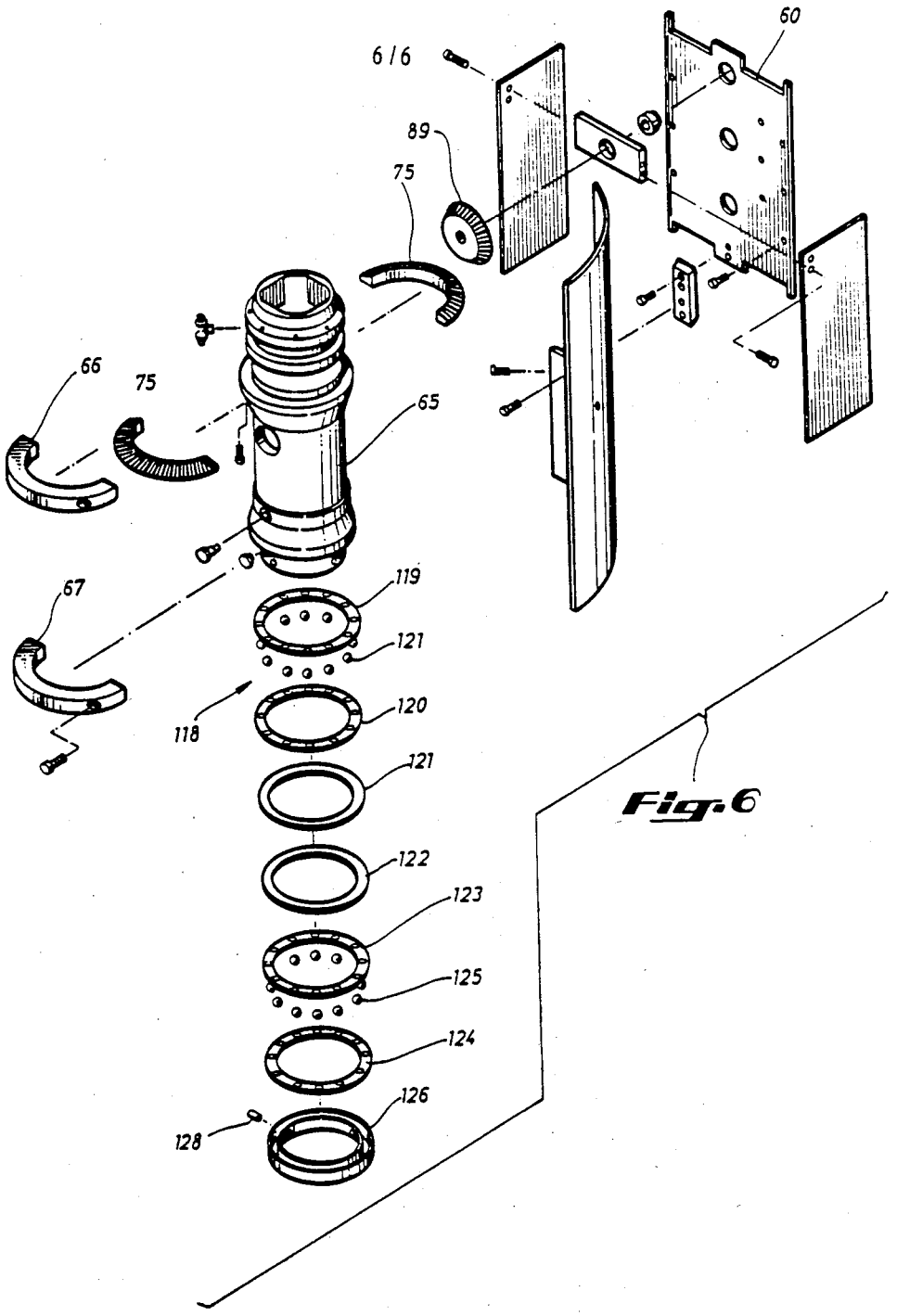
FIG. 6 is an exploded perspective showing a bearing assembly for use with the rotating canister.

As discussed above in connection with FIG. 4, upper arm member 58 and lower arm member 59 extending from engagement with guide tubes 56 to a point outboard of front cover plate 60. The outboard end of each arm is of a semicircular configuration for engagement with the side wall of tubular canister 65. Engagement of canister 65 with arms 58 and 59 is similar to engagement of the tubular canister 65 with semicircular clamp members 66 and 67 as described in U.S. Pat. No. 4,442,892, which patent has been expressly incorporated herein. As shown in FIG. 6, bevel gear 75 encircles canister 65 and is fixed thereto by allen screws or the like. Bevel gear 75 engages bevel gear 89 and causes rotation of canister 65 when bevel gear 89 is rotated.

When lower arm 59 and lower clamp member 67 are coupled to circumferentially engage canister 65, a relatively flat horizontal surface is provided on the bottom of arm 59 and clamp 67 for engagement with lower bearing assembly 118. Bearing assembly 118, shown in FIG. 6, includes bearing race 119 which is a circular ring washer-shaped configuration having sockets spaced thereabout. A bearing race 120 is similar to bearing race 119 and ball bearings 121 are trapped in corresponding sockets of rack 119 and race 120. Bearing race 119 abuts the lower surface of arm 59 and clamp 67. In abutting relationship to bearing race 120 is outer bearing race 121. Ring 122 abuts race 121 and provides a surface for race 123. Race 123 and 124 resemble races 119 and 120 and ball bearings 125 are captured between race 123 and 124. Lower sleeve bearing retainer 126 is a circular trough in which race 119, bearing 121, races 120, 121, 122 and 123, bearing 125, and race 124 are located. Bearing retainer 126 is secured to the outer periphery of canister 65 by means of set screws 128.

When the apparatus is in use and is positioned over a drill pipe joint through which there is an upward flow of fluids or gases, canister 65 will be forced upwardly and lower bearing assembly 118 will be forced into engagement with the lower surface of arm 59 and clamp 67. Because of the design of bearing assembly 118, rotation of canister 65 by means of crank wheel 90 can be accomplished without undue difficulty.

It now will be recognized that an improved safety apparatus has been provided that can be quickly and conveniently attached to the upper end of a drill pipe, regardless of size, in the event of an emergency, and which enables a valve to be threaded into the pipe and then closed to prevent upward flow of well fluids. The upper portion of the apparatus including the canister and safety valve are mounted on a swivel base so that latching of the clamp assembly can be accomplished with the valve out of the flow stream. Once the clamp assembly is secured to the drill pipe, the canister and valve are pivoted into position over the drill pipe using an alignment screw or other appropriate means and the apparatus is operated to cause the valve to be rotated and lowered, threading it into the box end of the drill pipe. A variety of drill pipe thread patterns can be accommodated by adjusting the drive mechanism to vary the ratio between th rate of rotation of the canister and its vertical displacement into the drill pipe. Finally, a bearing assembly provides improved operation of the apparatus under the conditions which may be normally expected.

Although the above description describes details of a preferred embodiment of the present invention, it will be understood by those skilled in the art that numerous other embodiments and applications of the invention may exist or be developed. Although in many such applications, all of the advantages of the illustrated embodiment may not be achieved, certain desirable attributes may be attainable. The scope of the present invention should accordingly be limited only by the scope of the appended claims.

What is claimed is:

1. In an apparatus for threading a valve into a well conduit for shutting off upward flow therethrough, the improvement comprising:

adjustable drive means for coordinating rotation and vertical displacement of said valve, said drive means operative to thread said valve into a plurality of drill pipe thread pitches.

2. The apparatus of claim 1, wherein said drive means includes:

a selectively positionable vertical displacement member;

a plurality of vertical drive means for selective engagement with said vertical displacement member;

a valve rotation means for rotating said valve; and an actuator for driving said plurality of vertical drive means and for driving said rotation means, the vertical displacement member and plurality of vertical drive means providing variable rates of vertical movement of said valve with respect to a single rate of rotation of said valve.

3. The apparatus of claim 2, wherein said plurality of vertical drive means includes:

a plurality of selectively positionable gears for individual location adjacent said vertical displacement member; and a control means for selecting between said gears and causing the selected gear to engage the vertical displacement member.

4. The apparatus of claim 1, wherein said drive means includes:

an elongated toothed member positionable alternatively in one of at least two positions;

at least two drive gears, one gear to engage said toothed member when said member is in one of its at least two positions and the other gear to engage said toothed member when said member is in the second of its at least two positions;

control means to control which of said two drive gears engages said toothed member;

an actuator for rotating said drive gears;

and valve rotation means actuatable by said actuator to rotate said valve simultaneously with rotation of said drive gears, the elongated toothed member position and the control means providing different rates of vertical displacement of said valve with respect to a single rate of rotation of said valve.

* * * * *